US006702864B2

(12) United States Patent
Hwo et al.

(10) Patent No.: US 6,702,864 B2
(45) Date of Patent: Mar. 9, 2004

(54) PROCESS FOR MAKING HIGH STRETCH AND ELASTIC KNITTED FABRICS FROM POLYTRIMETHYLENE TEREPHTHALATE

(75) Inventors: Charles Chiu-Hsiung Hwo, Sugar Land, TX (US); Hoe Hin Chuah, Houston, TX (US); Houston Slade Brown, Houston, TX (US); Kailash Dangayach, Houston, TX (US); Paul Karol Casey, Katy, TX (US)

(73) Assignee: Shell Oil Company, Houston, TX (US)

( * ) Notice: Subject to any disclaimer, the term of this patent is extended or adjusted under 35 U.S.C. 154(b) by 149 days.

(21) Appl. No.: 09/957,981

(22) Filed: Sep. 21, 2001

(65) Prior Publication Data

US 2002/0065010 A1 May 30, 2002

Related U.S. Application Data

(60) Provisional application No. 60/239,401, filed on Oct. 11, 2000.

(51) Int. Cl.[7] ..... D06P 3/52; D06P 7/00

(52) U.S. Cl. ..... 8/495; 8/497; 8/922; 8/931

(58) Field of Search ..... 8/495, 497, 922

(56) References Cited

U.S. PATENT DOCUMENTS

| | | | | | |
|---|---|---|---|---|---|
| 5,613,986 | A | | 3/1997 | Bessey et al. | 8/489 |
| 5,645,782 | A | | 7/1997 | Howell et al. | 264/103 |
| 5,662,980 | A | | 9/1997 | Howell et al. | 428/88 |
| 5,698,146 | A | | 12/1997 | Schippers et al. | 264/103 |
| 5,782,935 | A | * | 7/1998 | Hirt et al. | |
| 5,783,127 | A | | 7/1998 | Gross et al. | 264/103 |
| 6,012,912 | A | | 1/2000 | Gross et al. | 425/66 |
| 6,287,688 | B1 | | 9/2001 | Howell et al. | 428/364 |
| 6,333,106 | B2 | * | 12/2001 | Howell et al. | |
| 6,399,194 | B1 | | 6/2002 | Kunisada et al. | 428/357 |

FOREIGN PATENT DOCUMENTS

| | | | | |
|---|---|---|---|---|
| DE | 19505576 | | 8/1995 | D06P/3/54 |
| EP | 0745711 | A1 | 12/1996 | D02J/1/22 |
| EP | 0949363 | A2 | 10/1999 | |
| EP | 1016741 | A1 | 7/2000 | |
| EP | 1033422 | A1 | 9/2000 | |
| EP | 1052325 | A1 | 11/2000 | |
| JP | 11200175 | | 12/1997 | D03D/15/00 |
| WO | WO 01/66836 | A1 | 9/2001 | D01F/6/62 |

OTHER PUBLICATIONS

U.S. patent application Ser. No. 09/898,831, Moerman et al., filed Jul. 3, 2001.

International Search Report of Apr. 29, 2002 of PCT/EP 01/11731.

* cited by examiner

*Primary Examiner*—Margaret Einsmann
(74) *Attorney, Agent, or Firm*—Donald F. Haas

(57) ABSTRACT

This invention relates to a process of making high stretch elastic knitted fabrics from (PTT) which comprises:

(a) making a drawn textured yarn with an elongation to break of 30 to 60 percent by:
  (i) spinning a polytrimethylene terephthalate polymer into a partially oriented yarn, and
  (ii) draw texturing the yarn in a false-twisting texturing machine at a draw ratio of 1.05 to 2.0, and a yarn temperature of 50 to 200° C. using a either a contact heater or a non-contact heater, and (b) knitting the yarn into a fabric composed of intermeshing loops of the yarn wherein the stitch length is from 22 cm/100 stitches to 26 cm/100 stitches, and (c) scouring the knitted fabric, and (d) drying the fabric on a belt, and (e) dyeing the knitted fabric at atmospheric pressure by dispersing a dye and the fabric in water and increasing the temperature, and (f) finishing the dyed knitted fabric according to the specific procedure and (g) drying the fabric on a belt.

3 Claims, No Drawings

PROCESS FOR MAKING HIGH STRETCH AND ELASTIC KNITTED FABRICS FROM POLYTRIMETHYLENE TEREPHTHALATE

This application claims the benefit of provisional application Ser. No. 60/239,401 filed Oct. 11, 2000.

FIELD OF THE INVENTION

This invention relates to a process for producing high stretch and elastic knitted fabrics from polytrimethylene terephthalate fibers. More particularly, the invention relates to a combination of novel fabric constructions, and dyeing and finishing processes and conditions for producing such high stretch and elastic knitted fabrics.

BACKGROUND OF THE INVENTION

Polytrimethylene terephthalate (PTT) fibers are being developed for textile applications. It would be desirable to produce high stretch and elastic knitted fabrics from PTT. The conventional fabric construction and dyeing and finishing processes and conditions used for polyethylene terephthalate (PET) fibers and yarns do not, if used for PTT, produce a high stretch and elastic fabric. We have found that entirely different and more stringent knitted fabric constructions and dyeing and finishing conditions and processes are required in order to achieve high stretch and elastic fabrics made from PTT fibers or yarns.

SUMMARY OF THE INVENTION

This invention relates to a process of making high stretch elastic knitted fabrics from polytrimethylene terephthalate (PTT) which comprises:

(a) making a drawn textured yarn with an elongation to break of 30 to 60, preferably 35 to 55, percent by combining the steps of:
  (i) spinning a polytrimethylene terephthalate polymer into a partially oriented yarn, and
  (ii) draw texturing the yarn in a false-twisting texturing machine at a draw ratio of 1.05 to 2.0, preferably 1.15 to 1.5, and a yarn temperature of 50° C. to 200° C., preferably 130° C. to 180° C., using either a contact heater or a non-contact heater, and (b) knitting the yarn into a fabric composed of intermeshing loops of the yarn wherein the stitch length is from 22 cm/100 stitches to 26 cm/100 stitches, and (c) scouring the knitted fabric according to the following procedure:
  (i) load the fabric into a dyer with water at 30 to 40° C. for 12 to 15 minutes, and
  (ii) add 0.5 to 1.5% on weight of fabric of spin finish remover, and
  (iii) raise the temperature to 100° C. at a rate of 1.0 to 2.5° C., and
  (iv) hold for 5 to 10 minutes, and (d) drying the fabric:
  (i) on a belt at a speed 13 to 23 meter/minute through a forced air oven at a temperature of 88 to 98° C. with a residence time of 52 to 62 seconds, or
  (ii) on a belt at a speed 13 to 23 meter/minute through a tenter frame forced air oven at a temperature of 135 to 145° C. with a residence time of 52 to 62 seconds, and (e) dyeing the knitted fabric at atmospheric pressure by dispersing a dye and the fabric in water and increasing the temperature according to the following procedure:

(i) preheating the fabric to a temperature of from 25° C. to an upper limit of 44 to 54° C. by increasing the temperature at a rate of 1.0° C. to 2.5° C. per minute, and
  (ii) adding the dye chemicals to the fabric in water, and
  (iii) preheating the fabric to a temperature of from 44 to 54° C. to 55 to 65° C. by increasing the temperature at a rate of 1.0° C. to 2.5° C. per minute, and
  (iv) preheating the fabric to a temperature of from 55 to 65° C. to 105 to 115° C. by increasing the temperature at a rate of 1 to 2° C. per minute, and
  (v) maintaining the dyeing solution at this temperature for from 30 to 50 minutes, and (f) finishing the dyed knitted fabric according to the following procedure:
  (i) cooling the dyed knitted fabric to 88 to 98° C. at a cooling rate of 1° C. to 2° C. per minute, and
  (ii) adding reduction agent(s) for scouring which is carried out for from 3 to 7 minutes, and
  (iii) cooling the dyed knitted fabric to 55 to 65° C. at a cooling rate of 1.0° C. to 2.5° C. per minute, and
  (iv) washing the dyed knitted fabric with room temperature water for from 10 to 20 minutes, and
  (v) adding a solution of 0.25 to 0.75 weight percent weak organic acid, and
  (vi) heating the dyed knitted fabric to 44 to 54° C. at a rate of 1.0 to 2.5° C. per minute and holding it at that temperature for from 5 to 15 minutes, and
  (vii) washing the dyed knitted fabric at 34 to 44° C. for 5 to 10 minutes, and
  (viii) removing the fabric, and (g) drying the fabric:
  (i) on a belt at a speed of 13 to 23 meter/minute through a forced air oven at a temperature of 88 to 98° C. with a residence time of 52 to 62 seconds, or
  (ii) on a belt at a speed of 13 to 23 meter/minute through a tenter frame forced air oven at a temperature of 135 to 145° C. with a residence time of 52 to 62 seconds.

DETAILED DESCRIPTION OF THE INVENTION

It is important that the PTT yarn by draw textured in a false-twisting draw texturing machine at a draw ratio of 1.05 to 2.0, preferably 1.15 to 1.5, and a yarn temperature of 50 to 200° C., preferably 130 to 180° C. if using either a contact heater or a non-contact heater. Further, it is important that the yarn be knitted into a fabric composed of intermeshing loops of the yarn wherein the stitch length is from 22 centimeters/100 stitches to 26 centimeters/100 stitches.

PTT can be knitted and woven into many different fabric constructions. The possibilities for PTT yarns and fibers are virtually identical to other fibers such as polyester and nylon.

PTT can be used as both the fill (weft) yarn and/or the warp yarn. Fabric properties will depend on weaving tensions and finishing conditions, and are beyond the scope of this specification.

PTT can be used in knitting applications. Fabric properties will depend on knitting tension and stitch length, as well as finishing conditions. An example for an interlock fabric is described below.

While each fabric will have its own set of unique properties from the way it was made, PTT should be able to impart softness, bulk and/or good feel (soft touch). A balance will come from the particular construction, and from the way the fabric was finished. In general, some of the considerations are:

The fabric should be constructed in such a way that it accounts for shrinkage of the PTT yarn. A PTT draw textured yarn (DTY) will have 40% of more shrinkage at 100° C. (stretch yarn) and 0–40% shrinkage for a set yarn. This shrinkage will occur when the fabric is finished or dyed, and must be accounted for in the construction. Desired attributes in a fabric may not be obtained when the shrinkage is not taken into account. For example, if there is a 40% shrinkage in a knit, and the knit is finished with no decrease in width, the fabric will be stiff and lifeless.

If knitting and weaving tensions are excessively high, this will cause excessive shrinkage in the fabric. In some constructions, the yarns will lock onto themselves, making stretch impossible.

Temperatures in excess of 140° C. should be used cautiously. While the exact temperature a fabric sees is dependent on the nascent temperature and the amount of time that the fabric sees that temperature, temperatures greater than 140° C. can cause permanent loss of properties in the PTT yarn which makes up the fabric.

Dyeing temperatures should not exceed 140° C. In general, 110° C. is the most that is needed. PET blends with PTT may need somewhat higher temperatures.

Care must be taken during the dyeing procedure not to excessively stretch the fabric. Jet dyers tend to give a less destructive drying cycle.

The interlock construction is a good way to see the stretch and soft touch of PTT in a fabric. An interlock fabric was constructed using a 70/34 DTY. The DTY had about 44% boiling water shrinkage. Tenacity was 3.0 g/denier, and 35% elongation.

Several different knitting machines were used. A 32 cut, a 28 cut, and a 24 cut. The 28 cut, with normal knitting tensions gave the softest of the fabrics. Special attention was given to the length that the needle penetrated the fabric. By increasing this (but not the stitch length), a softer (to the hand) fabric was obtained.

There are very few knitting parameters (other than stitch length) which can be varied. Getting the correct DTY for the process will eventually determine the fabric properties.

PTT uses disperse dyes like PET. The carriers necessary to get good dye penetration into PET are not necessary for PTT. Neither is excessive temperature and pressure.

The dyeing rate of PTT with disperse dyes is very similar to that of PET, although the dyeing temperature of PTT is only 100° C. compared to 130–140° C. for PET.

There are different sizes of dye molecules. The larger the molecule, the more energy is necessary to get the molecule to penetrate the fiber. Above, we have discussed conditions for a low energy dye. A medium energy or high energy dye may need an additional 10° C. to get better penetration into the PTT fiber.

Disperse dyes are used at owf (on the weight of fabric) necessary to give good color shade. A temperature of 100–110° C. is recommended. Temperatures above 110° C. will not give more exhaustive dyeing. Higher temperature will also not give faster dye penetration. Two inflection points exist, one at 80° C., the other at 95° C.

Dyeing can be started at ambient temperature and raised to the dyeing temperature at a rate of 3° C./min and hold at the dyeing temperature for 20–40 minutes. After dyeing, the fabrics are rinsed until no further dye bleeds from the fabric. Reduction scouring can be important (see below), especially for dyes whose interaction with PTT is unknown.

A pH of 7 can be used for all disperse dyes. If pH adjustment due to dye stability at a different pH, then the following chemicals can be used to adjust pHs:

acetic acid/sodium acetate for the acidic pHs sodium carbonate/sodium bicarbonate for the weak alkaline solutions sodium hydroxide for pHs above 11.

The recommended temperature profile is 5–10° C./min when temperatures are below 70° C.; 3–5° C./min for temperatures between 70–80° C.; and 1–2° C./min from 80–100° C. (low energy dye) and 80–110° C. (medium to high energy dye).

The recommended dyeing temperature for PTT with low energy disperse dyes is 100° C., and 110° C. with medium and high energy disperse dyes. Temperatures below 100° C. will result in less dye exhaustion; temperature above 110° C. will not increase the dye exhaustion. There were two temperature ranges which affected the equilibrium dye sorption considerably. They are 70–80° C., and 95–100° C. Below 60° C., there is little dye sorption.

The recommended dyeing pH for PTT with disperse dyes is 7. Due to the stability of most disperse dyes in a broad pH range, e.g., from 4 to 9, no pH adjustment is required for PTT dyeing. Even those with poor pH stability under high temperature dyeing conditions require no pH adjustment. This is due to the low temperature dyeability of PTT. Therefore, the pH stability of the disperse dyes is considerably increased. It is, however, often desirable for dye and or fabric properties to alter the pH. This can be done as above under control of pH.

Possible auxiliary chemicals include the following:

dispersant lubricant chelating agent defoamer/deaerator leveling agent

The use of these chemicals depends on the dyeing machines, the quality of water being used, the dye properties, and the end-product requirement. Use only if they are necessary.

The color fastness to laundering of a PTT fabric can be greatly affected by reduction scouring, as shown below. In general, reduction scouring represents a safety step to make sure that dye is not bled to other fabrics and fibers. Work has been done to assure that the lower dyeing temperature of PTT does not mean "easy in–easy out." However, many dyes will exhibit different solubility and equilibrium behavior at 100° C. vs. 130° C. The reduction scour represents a good way to insure that small particles of dye are not left adhering to the surface of the PTT fibers.

Chemicals commonly used for reduction scour include:

Caustic (sodium hydroxide) and hydro(sodium hydrosulfite) or

Soda ash (sodium carbonate) and Thiox(formamidine sulfinic acid)

The negative attribute of reduction scouring is that some reduction in color intensity can be seen.

| Laundering Fastness of a Black Woven Fabric Before Reduction Scouring | | | | | | |
|---|---|---|---|---|---|---|
| | Color Stain on #10 Multifiber* | | | | | |
| Color Change | Acetate | Cotton | Nylon | Polyester | Acrylic | Wool |
| 4–5 | 3 | 5 | 2–3 | 4–5 | 5 | 4 |
| Laundering Fastness of a Black Woven Fabric After Reduction Scouring | | | | | | |
| | Color Stain on #10 Multifiber* | | | | | |
| Color Change | Acetate | Cotton | Nylon | Polyester | Acrylic | Wool |
| 5 | 4 | 5 | 4 | 5 | 5 | 5 |

*The scale of 5 being the best and 1 the worst.

Fabric finishing is broken into several steps. These include:

1. Scour or "pre-scour." This can be used to treat the fabric, or to simply remove coning oils, spin finish, etc. It can also be referred to as a fabric wash. This pre-treatment is usually done in the dyeing machine, and is useful to get level (uniform) dyeing.
2. Pre-heat set. The fabric can be heat set before dyeing. Some fabrics find this essential for attaining superior performance. This can be an expensive step to add, and many do not feel it is necessary.
3. Dyeing. In this step, the dye chemicals are actually added, and dyeing is done.
4. Heat set. The fabric is usually heat set after dyeing. This helps to remove wrinkles from the fabric, as well as set the width and properties of the fabric.

Pre-scour before dyeing may be considered if the fabric is not pretreated. The choice of chemicals used depends on how aggressively the fabric (or fabrics) will be cleaned. A good general purpose cleaner would be 0.5% Actisol. A more aggressive choice would be 0.05% Jeffsol (propylene carbonate).

The following dyeing and finishing procedure is a sample dyeing procedure used for an interlock stretch fabric. The dyer used was a "tube" or "cigar" type jet dryer. All % and weights based on owf.

| Step | Action |
|---|---|
| 1 | Fill dryer with water at 38° C. |
| 2 | Load fabric into dyer |
| 3 | Add 0.5% Actisol (to wash fabric) |
| 4 | Run dyer for 20 minutes |
| 5 | Wash with water in dyer for 15 minutes |
| 6 | Heat to 49° C. at 1.7 degrees per minute |
| 7 | Add dye bath chemicals. This would include 1% of a buffer (to maintain pH 7) and 3% Dyol 2447 (Boehme-Filatex) leveling/disperse agent. (Approximately 5 minutes) |
| 8 | Add dyes by backwashing dyes into dyer. In this case 0.092% Foron Blue S-BGL, 0.004% Foron Red RD-BR, and 0.06% Intrasin Orange 2 GR was used. (Approximately 5 minutes) |
| 9 | Heat to 60° C. at 1.7 degrees per minute |
| 10 | Heat to 110° C. at 1 degree per minute |
| 11 | Run at 110° C. for 40 minutes |

-continued

| Step | Action |
|---|---|
| 12 | Cool to 82° C. at 1 degree per minute |
| 13 | Add chemicals for reduction scour. These were 2% soda ash (sodium carbonate), 1% Thiox (foramidine sulfinic acid). |
| 14 | Run at 82° C. for 5 minutes |
| 15 | Cool to 60° C. at 1.7 degrees per minute |
| 16 | Wash for 15 minutes. Wash clear. |
| 17 | Add 0.5% acetic acid |
| 18 | Heat to 50° C. at 1.7 degrees per minute |
| 19 | Run at 50° C. for 10 minutes |
| 20 | Wash at 38° C. for 10 minutes |
| 21 | Unload the fabric |

EXAMPLES

Example 1

A 32 gauge fabric, interlock knit, with about 8 oz. fabric weight were dyed, using the conditions below. Stretch was lost during the dyeing step at 110° C. The fabric was split into two parts to compare the two procedures, with about ½ the fabric from each style on each procedure.

1. Procedure 1 and 2. Scour. The fabric was loaded into the Future jet dryer. A cold water wash (35° C., about 95° F.) was done for 10–15 minutes to remove most of the spin finish. The water was flushed, 1% owf Milease T was added to help scouring and lubrication, and the temperature profile ramped to 212° F. (100° C.). The temperature was held at 212° F. (100° C.) for ten minutes, then cooled back down to room temperature. The heating and cooling steps each took about 20 minutes. See detailed procedure below.
2. Procedure 1 and 2. Dyeing. The fabric was dyed at 110° C. (230° F.) in a jet dyer (Futura, Gaston County) machine. (Same machine as used for scouring). See detailed procedure below.
3. Procedure 1 and 2. Dry. The fabric was dried on a belt, forced air oven. A temperature of 200° F. (about 93° C.) was used, and the machine speed was 18 yards (16.5 meters) per minute.
4. Procedure 1 and 2. The fabric was run through a tenter frame, with a heat set of 140° C. (284° F.) at 18 yards per minutes.

| | |
|---|---|
| Actual scouring procedure | 1. Fill at 100° F. (37.8° C.)<br>2. Load at 100° F. (37.8° C.)<br>3. Wash at 100° F. (37.8° C.) for 15 minutes<br>4. Add chemical scouring agent, 1 Milease T<br>5. Heat to 212° F. (100° C.) at 3° F. (1.7° C.) per minute<br>6. Run at 212° F. (100° C.) for 10 minutes |
| Actual dyeing procedure | 1. Load fabric<br>2. Wash at 100° F. (37.8° C.) for 10 minutes<br>3. Heat to 120° F. (48.9° C.), at 3° F. (1.7° C.)/minute<br>4. Add dye to bath at 120° F. (48.9° C.)<br>5. Add dyes at 120° F. (48.9° C.) in two parts. Back wash slowly.<br>6. Heat to 140° F. (60° C.) at 3° F. (1.7° C.) per minute<br>7. Heat to 230° F. (110° C.) at 2° F. (1.1° C.) per minute<br>8. Run at 230° F. (110° C.) for 40 minutes<br>9. Cool to 180° F. (82° C.) at 2° F. (1.1° C.) per minute<br>10. No sample |

-continued

| | |
|---|---|
| | 11. Add after clear-Soda ash and Thiox |
| | 12. Run at 180° F. (82° C.) for 5 minutes |
| | 13. Cool at 140° F. (60° C.) at 3° F. (1.7° C.) per minute |
| | 14. Wash clear, and neutralize |
| | 15. Add acetic acid, ½% |
| | 16. Heat to 120° F. (48.9° C.) at 3° F. (1.7° C.) per minute |
| | 17. Run at 120° F. (48.9° C.) for 10 minutes |
| | 18. Wash at 100° F. (37.8° C.) for 10 minutes until clear |
| | 19. Unload |
| Dye | The dye was composed of the following: |
| | 1.00% Lydcol-Rdn Liq, -Lubrication, leveling agent, and dispersing aid |
| | 0.25% Hydroquest 444-chelating agent (like EDTA) |
| | 1.00% Buffer pH-7 |
| | 6.00% Foron Black S-K Paste |
| | 1.20% Sodyecron Navy AR 100% |
| | 0.50% Intrasil Orange 2 GR |
| | All 3 medium to high energy dyes |
| | After dyeing, step 11 above adds 2.0% soda ash and 1.0% Thiox (foramidine sulfinic acid reducing agent). |
| | To clear this up, step 15 uses 0.5% acetic acid. |
| | All percentages are owf |

| Results on scouring | Fabric | Width before scour | Width after scour |
|---|---|---|---|
| | From M-700* | 68.5" (1.74 m) | 51.5–52.5" (1.31–1.33 m) |
| | From AFK* | 68.5–71" (1.74 m–1.80 m) | 47.75 (1.21 m) |

*Two types of DTY machines made by Barmag

TABLE 1

Dyeing/Finishing Procedure 1 Fabrics

| Yarn I.D. | Lot Number | Piece Number | Style Number | Fabric Weight | Width After Dyeing | Comments |
|---|---|---|---|---|---|---|
| A | L11 | P1 | S1 | 19.9 lb. (9.03 kg) | 36.1" (0.92 m) | Stretch & power |
| | L12 | | | 20.6 lb. (9.34 kg) | | Stretch & power |
| B | L13 | P2 | S2 | 22.0 lb. (9.98 kg) | 49.1" (1.25 m) | Poor power |
| | L14 | | | 27.7 lb. (12.56 kg) | | Not tested |
| C | L15 | P3 | S3 | 19.8 lb. (8.98 kg) | 43.35" (1.10 m) | Stretch & power |
| | L16 | | | 18.9 lb. (8.57 kg) | | Not tested |
| | L17 | | | 6.1 lb. (2.77 kg) | | Not tested |
| D | L18 | P4 | S4 | 21.5 lb. (9.75 kg) | 51.22" (1.30 m) | Not tested |
| | L19 | | | 22 lb. (9.98 kg) | | Stretch & power |

TABLE 2

Dyeing/Finishing Procedure 2 Fabrics

| Yarn I.D. | Lot Number | Piece Number | Style Number | Fabric Weight | Width After Dyeing | Comments |
|---|---|---|---|---|---|---|
| A | L21 | P1 | S1 | 43.5 lb (19.7 kg) | 52" (1.32 m) | Poor stretch |
| | L22 | | | 10.0 lb (4.5 kg) | 52" (1.32 m) | Stretch and power |
| B | L23 | P2 | S2 | 43.5 lb (19.7 kg) | 52" (1.32 m) | Poor power |

TABLE 2-continued

Dyeing/Finishing Procedure 2 Fabrics

| Yarn I.D. | Lot Number | Piece Number | Style Number | Fabric Weight | Width After Dyeing | Comments |
|---|---|---|---|---|---|---|
| C | L24 | P3 | S3 | 19.7 lb (8.9 kg) | 47" (1.19 m) | Stretch & power |
| | L25 | | | 20.8 lb (9.4 kg) | 47" (1.19 m) | Poor power |
| D | L26 | P4 | S4 | 21.9 lb (9.9 kg) | 47" (1.19 m) | Stretch & power |
| | L27 | | | 20.9 lb (9.5 kg) | 47" (1.19 m) | Poor power |

Conclusion: It is not necessary to use heat setting for good stretch and powerful recovery fabrics. The DTY yarn made with higher texturing yarn speed (greater than or equal to 400 meter/minute) would give good fabric stretch and power recovery.
The draw ratio could be from 1.2 to 1.4.

Conclusion: It is not necessary to use heat setting for good stretch and powerful recovery fabrics. The DTY yarn made with higher texturing yarn speed (greater than or equal to 400 meter/minute) would give good fabric stretch and power recovery. The draw ratio could be from 1.2 to 1.4.

TABLE 3

| Lot number | Fabric Stretch,* % | Fabric Recovery,** % | Comments |
|---|---|---|---|
| L23 | 100 | 60 | No power |
| L15 | 100 | 75 | Stretch & power |
| L19 | 110 | 75 | Str. & pwr. |
| L13 | 100 | 60 | Seems to pull out |
| L11 | 95 | 80 | Str. & pwr. |
| L27 | 120 | 50 | No power |
| L24 | 100 | 70 | Str. & pwr |
| L21 | 80 | 70 | Poor stretch |
| L22 | 100 | 90 | Greige***, scoured, heat set |
| L26 | 120 | 85 | Greige, scoured, heat set |
| Unknown | 130 | 100 | Greige, scoured, not heat set |

*Greater or equal to 90% for good stretch
**Greater or equal to 70% for power
*Unfinished fabric just off the knitting machine As indicated in the column of comments of Table 3 fabrics with lot numbers, L15, L19, L11 and L24** have both good (high) stretch and high recovery after stretch.

A Monarch LIL Size 30 (30 inches [0.76 m] diameter) Circular Interlock Knitting Machine was used. This is a 84 feed machine, run at 24 rpm. It is Contempora machine #25. It is a 32 cut (32 gauge, i.e., 32 needles per inch [12.6 per cm]) machine, and it uses 3096 needles. (Calculated would be 3016 needles).

The following draw-textured yarns were made for the different fabrics for the studies of stretch and recovery in this application.

TABLE 4

| Lot Number | A | B | C | D |
|---|---|---|---|---|
| Denier, g | 77.47 | 85.8 | 79.67 | 86.0 |
| Tenacity, g/d | 2.75 | 2.39 | 2.88 | |
| Elongation, % | 36.1 | 49.2 | 43.25 | 51.0 |
| Skein Shrinkage,* % | 46.1 | 41.6 | 44.59 | |
| Machine | M-700 | M-700 | AFK | AFK |
| Speed (M/m) | 500 | 275 | 450 | 425 |
| Draw Ratio | 1.367 | 1.23 | 1.3365 | 1.23 |
| Discs lay-out | 1-6-1 | 1-5-1 | 1-3-1 | 1-3-1 |

TABLE 4-continued

| Lot Number | A | B | C | D |
|---|---|---|---|---|
| Disc thickness material | 6 mm Kyocera | 6 mm Kyocera | 9 mm Kyocera | 9 mm Kyocera |
| Spacing, mm | 0.5 | 0.5 | 0.5 | 0.5 |
| D/y ratio | 2.49 | 2.35 | 2.10 | 2.10 |
| Heater Temp (° C.) | 160 | 160 | 220/220 | 220/220 |
| Tube Color | Black | Blue | Red | Green |

*A continuous strand of yarn in the form of a collapsed coil.

Conclusion: The draw ratio and the heater temperature used in the above examples can give the textured yarns that are quite suitable to be made into fabrics under certain knitting and weaving configuration for good high stretch and power recovery.

(d) drying the fabric:

(i) on a belt at a speed 13 to 23 meter/minute through a forced air oven at a temperature of 88 to 98° C. with a residence time of 52 to 62 seconds, or (ii) on a belt at a speed 13 to 23 meter/minute through a tenter frame forced air oven at a temperature of 135 to 145° C. with a residence time of 52 to 62 seconds, and (e) dyeing the knitted fabric at atmospheric pressure by dispersing a dye and the fabric in water and increasing the temperature according to the following procedure:

(i) preheating the fabric to a temperature of from 25° C. to an upper limit of 44 to 54° C. by increasing the temperature at a rate of 1.0° C. to 2.5° C. per minute, and (ii) adding the dye chemicals to the fabric in water, and

TABLE 5

| Run # | Fabric length feed, meters | Calcu'd* stitch length, cm/100 stitch | Greige fabric width, cm | Greige fabric % stretch | Greige fabric % recovery | Boil off fabric % stretch | Boil off fabric % recovery | Boil off fabric width, cm | Remark |
|---|---|---|---|---|---|---|---|---|---|
| 1 | 8.69 | 25.65 | | 60 | 98 | 61 | 96 | | No power |
| 2 | 7.94 | 23.45 | | 60 | 97 | 60 | 98 | 81.3 | stretch & pwr |
| 3 | 7.29 | 21.52 | | 48 | 90 | 32 | 97 | 79.4 | poor str. |
| 4** | 8.125 | 24.64 | 90.2 | 60 | 98 | 62 | 98 | 81.9 | str. & pwr. |
| 5** | 8.125 | 24.64 | 87.0 | 68 | 97 | 63 | 97 | 82.6 | str. & pwr. |
| 6 | 7.11 | 21 | 87.0 | 50 | 100 | 42 | 99 | 75.6 | poor str. |
| 7 | 7.85 | 23.17 | 88.3 | 75 | 95 | 66 | 97 | 75.6 | str. & pwr |
| 8 | 8.59 | 25.38 | 88.3 | 85 | 98 | 70 | 98 | 78.1 | str. & pwr. |
| 9** | 8.125 | 24.64 | 87.0 | 70 | 99 | 70 | 98 | 74.6 | str. & pwr. |
| 10** | 8.125 | 24.64 | 87.0 | 78 | 100 | 82 | 100 | 75.3 | str. & pwr. |

*Based on the knitted machine used: 30 inches (0.76 m) in diameter, 32 guage (32 needles per inch [12.6 per cm]). Total needle used was 3096 (calculated would be 3016). Stitch length (cm/100 stitch) = fiber length fee per machine revolution/total no. of needles × 100.

**Fabrics were suitable for subsequent dyeing and finishing evaluation. Fabric No. 4 was used for actual evaluation in dyeing and finishing.

Conclusion: As indicated in Table 5, to obtain good stretch and power, the stitch length should be from 23 to 25.5 cm/100 stitches in order to obtain power and good stretch (% stretch≧60% and % recovery≧97%)

We claim:

1. A process of making a high stretch elastic knitted fabric from polytrimethylene terephthalate which comprises:

(a) making a drawn textured yarn with an elongation to break of 30 to 60 percent by combining the steps of:

(i) spinning a polytrimethylene terephthalate polymer into a partially oriented yarn, and (ii) draw texturing the yarn in a false-twisting texturing machine at a draw ratio of 1.05 to 2.0 and a yarn temperature of 50° C. to 200° C., and (b) knitting the yarn into a fabric composed of intermeshing loops of the yarn wherein the stitch length is from 22 cm/100 stitches to 26 cm/100 stitches, and (c) scouring the knitted fabric according to the following procedure:

(i) load the fabric into a dyer with water at 30 to 40° C. for 12 to 15 minutes, and (ii) add 0.5 to 1.5% on weight of fabric of spin finish remover, and (iii) raise the temperature to 100° C. at a rate of 1.0 to 2.5° C., and (iv) hold for 5 to 10 minutes, and (iii) preheating the fabric to a temperature of from 44 to 54° C. to 55 to 65° C. by increasing the temperature at a rate of 1.0° C. to 2.5° C. per minute, and (iv) preheating the fabric to a temperature of from 55 to 65° C. to 105 to 115° C. by increasing the temperature at a rate of 1 to 2° C. per minute, and (v) maintaining the dyeing solution at this temperature for from 30 to 50 minutes, and (f) finishing the dyed knitted fabric according to the following procedure:

(i) cooling the dyed knitted fabric to 82 to 98° C. at a cooling rate of 1° C. to 2° C. per minute, and (ii) adding reduction agent(s) for scouring which is carried out for from 3 to 7 minutes, and (iii) cooling the dyed knitted fabric to 55 to 65° C. at a cooling rate of 1.0° C. to 2.5° C. per minute, and (iv) washing the dyed knitted fabric with room temperature water for from 10 to 20 minutes, and (v) adding a solution of 0.25 to 0.75 weight percent weak organic acid, and (vi) heating the dyed knitted fabric to 44 to 54° C. at a rate of 1.0 to 2.5° C. per minute and holding it at that temperature for from 5 to 15 minutes, and (vii) washing the dyed knitted fabric at 34 to 44° C. for 5 to 10 minutes, and (viii) removing the fabric, and (g) drying the fabric:

(i) on a belt at a speed of 13 to 23 meter/minute through a forced air oven at a temperature of 88 to 98° C. with a residence time of 52 to 62 seconds, or (ii) on a belt at a speed of 13 to 23 meter/minute through a tenter frame forced air oven at a temperature of 135 to 145° C. with a residence time of 52 to 62 seconds.

2. The process of claim 1 wherein the yarn is made with an elongation to break of 35 to 55 percent and the draw texturing in step (a) (ii) is carried out a draw ratio of 1.15 to 1.5 and a yarn temperature of 130° C. to 180° C.

3. The process of claim 1 wherein the stitch length in step (b) is from 23 to 25.5 cm/100 stitches.

* * * * *